US008348454B2

(12) United States Patent
Henry et al.

(10) Patent No.: US 8,348,454 B2
(45) Date of Patent: Jan. 8, 2013

(54) FLASHLIGHT WITH INTEGRATED CLAMP HANDLE

(75) Inventors: Louis F. Henry, Scarsdale, NY (US); Justin Cohen, New York, NY (US)

(73) Assignee: Blackbeam LLC, New York, NY (US)

( * ) Notice: Subject to any disclaimer, the term of this patent is extended or adjusted under 35 U.S.C. 154(b) by 478 days.

(21) Appl. No.: 12/322,214

(22) Filed: Jan. 30, 2009

(65) Prior Publication Data

US 2009/0279290 A1 Nov. 12, 2009

Related U.S. Application Data

(63) Continuation-in-part of application No. 12/151,330, filed on May 6, 2008, now Pat. No. 7,850,329.

(51) Int. Cl.
*F21L 4/00* (2006.01)
*F21L 4/04* (2006.01)

(52) U.S. Cl. ..... 362/199; 362/196; 362/197; 362/198; 362/200; 362/201; 362/202; 362/203; 362/204; 362/205; 362/206; 362/207; 362/208

(58) Field of Classification Search ..... 362/196–208
See application file for complete search history.

(56) References Cited

U.S. PATENT DOCUMENTS

| | | | | |
|---|---|---|---|---|
| 1,606,219 A | | 11/1926 | Havens | |
| 4,399,498 A | | 8/1983 | Bacevius | 362/396 |
| 4,533,982 A | | 8/1985 | Kozar | 362/183 |
| 4,654,764 A | | 3/1987 | Hsiao | 362/199 |
| D324,110 S | | 2/1992 | Yuen | D26/44 |
| 5,101,333 A | | 3/1992 | Glassford | |
| 5,448,463 A | | 9/1995 | Leen | 362/396 |
| D376,865 S | | 12/1996 | Chan | D26/60 |
| D378,434 S | | 3/1997 | Petterson et al. | D26/44 |
| D404,839 S | | 1/1999 | Petterson et al. | D26/44 |
| D410,557 S | | 6/1999 | Petterson et al. | D26/44 |
| 5,993,022 A | * | 11/1999 | Neyer et al. | 362/199 |
| 6,012,827 A | * | 1/2000 | Caplan et al. | 362/396 |
| D428,175 S | | 7/2000 | Lynch et al. | D26/44 |
| 6,176,592 B1 | | 1/2001 | Kovacik et al. | 362/199 |
| 6,457,841 B1 | | 10/2002 | Lynch et al. | 362/199 |
| D467,375 S | | 12/2002 | Lynch et al. | D26/44 |
| 6,575,587 B2 | | 6/2003 | Cramer et al. | 362/105 |

(Continued)

FOREIGN PATENT DOCUMENTS

CN 1645417 A 7/2005

OTHER PUBLICATIONS

International Search Report from corresponding PCT/US2009/042830 dated Jul. 7, 2009.

(Continued)

*Primary Examiner* — William Carter
(74) *Attorney, Agent, or Firm* — Ohlandt, Greeley, Ruggiero & Perle, L.L.P.

(57) ABSTRACT

A flashlight having a handle with a clamp integrated therein, so that the flashlight can be used in either hands-free or in a portable mode. The handle of the flashlight can comprise clamp arms that are biased in a closed position, and can form a clamp, which can be affixed to an object. A battery housing can be disposed between the clamp arms, or one or both of the clamp arms.

15 Claims, 5 Drawing Sheets

U.S. PATENT DOCUMENTS

| | | | | |
|---|---|---|---|---|
| 6,585,400 | B2 | 7/2003 | Leen | 362/418 |
| D496,483 | S | 9/2004 | Christianson | D26/60 |
| 6,802,623 | B1 | 10/2004 | Hsu et al. | 362/199 |
| 6,905,223 | B2 | 6/2005 | Halasz | 362/197 |
| 6,913,370 | B2 | 7/2005 | Ping | 362/199 |
| 7,011,423 | B2 | 3/2006 | Chen | 362/102 |
| 7,040,783 | B1 * | 5/2006 | Christianson | 362/396 |
| 7,063,435 | B2 | 6/2006 | Dallas et al. | |
| 7,111,965 | B2 | 9/2006 | Hsu | 362/396 |
| 7,172,310 | B2 | 2/2007 | Hsu | 362/197 |
| 7,175,318 | B2 | 2/2007 | Booty, Jr. | 362/396 |
| D541,965 | S | 5/2007 | Shiu | D26/60 |
| D542,450 | S | 5/2007 | Shiu | D26/60 |
| 7,222,996 | B2 | 5/2007 | Lin | 362/396 |
| D554,783 | S | 11/2007 | Shiu | D26/39 |
| 7,318,657 | B2 | 1/2008 | Booty, Jr. | 362/190 |
| 7,357,540 | B2 | 4/2008 | Booty, Jr. | 362/396 |
| 7,390,105 | B2 | 6/2008 | Nelson et al. | 362/198 |
| 7,410,272 | B2 | 8/2008 | Halasz | 362/296 |
| 7,481,554 | B2 | 1/2009 | Anderson et al. | 362/250 |
| 7,513,662 | B2 | 4/2009 | Parker et al. | 362/396 |
| 7,540,623 | B2 | 6/2009 | Petzl et al. | 362/197 |
| 7,572,024 | B2 | 8/2009 | Ko et al. | 362/191 |
| D605,795 | S | 12/2009 | Baker et al. | D26/44 |
| 7,850,329 | B2 | 12/2010 | Henry et al. | |
| 2005/0105286 | A1 * | 5/2005 | Dallas et al. | 362/119 |
| 2007/0076410 | A1 * | 4/2007 | Halasz | 362/197 |
| 2008/0055888 | A1 | 3/2008 | Sharrah et al. | 362/106 |
| 2009/0122562 | A1 | 5/2009 | Lee | 362/396 |
| 2009/0154161 | A1 | 6/2009 | Parker et al. | 362/249.05 |
| 2010/0091483 | A1 | 4/2010 | Henry et al. | |

OTHER PUBLICATIONS

English Translation of Chinese Office Action dated Jul. 12, 2010 from corresponding CN Application No. 200810215919.7.

European Search Report dated Apr. 26, 2011 from corresponding EP 09743456.7.

* cited by examiner

FLASHLIGHT WITH INTEGRATED CLAMP HANDLE

CROSS-REFERENCE TO RELATED APPLICATIONS

The present application is a continuation-in-part of U.S. patent application Ser. No. 12/151,330, filed on May 6, 2008 now U.S. Pat. No. 7,850,329.

BACKGROUND OF THE DISCLOSURE

1. Field of the Disclosure

The present disclosure relates to flashlights having handles that have a clamp integrated therein.

2. Background

There is a significant need among users of flashlights to have some sort of "hands-free" capability, so that the user can have both hands available to work on a task while the flashlight illuminates a work space. Some currently available flashlights, however, require additional bulky mechanisms that need to be affixed to the flashlight, and take up a lot of space, to provide this utility. In addition, other currently available flashlights that can illuminate a space and allow for hands-free operation by a user are not portable, and can not be easily manipulated or carried around by the user. There are no flashlights available that can provide both capabilities at the same time.

Accordingly, there is a need for a flashlight that can provide hands-free operation for a user, while simultaneously providing a portable capability.

SUMMARY OF THE DISCLOSURE

The present disclosure overcomes these and other disadvantages of the flashlights of the prior art by providing a novel illumination device, such as a flashlight, that integrates a clamp that can be affixed to an object into a handle of the device. This allows the flashlight to be used in either hands-free or portable modes.

In one embodiment, the present disclosure provides an illumination device. The illumination device comprises a head comprising a light-emitting portion, a support member connected to the head, and a handle connected to the support member. The handle comprises a first clamp arm and a second clamp arm, so that an end of the first clamp arm and the second clamp arm form a clamp on an opposite side of the handle from the support member.

In another embodiment, support member has a chamber connected thereto, that runs along a longitudinal axis of the illumination device, in a direction away from the head. The chamber has a pivot pin running through a bottom portion thereof. The first clamp arm, the second clamp arm, and the chamber are connected to each other with the pivot pin.

In another embodiment, the first clamp arm and the second clamp arm have flexible ends that are connected to the support member, and flex when the first clamp arm and the second clamp arm are moved toward one another. The first clamp arm and the second clamp arm have clamp ends opposite the flexible ends, which intertwine to form the clamp.

DETAILED DESCRIPTION OF THE DISCLOSURE

Figure 1:
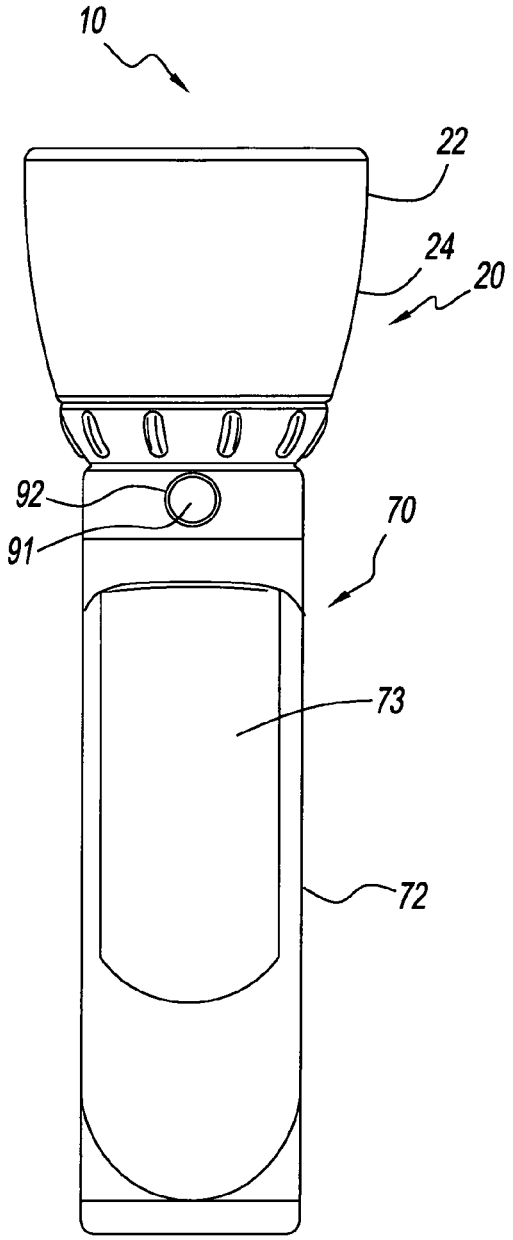
FIG. 1 is a top view of a flashlight of the present disclosure.
Figure 2:
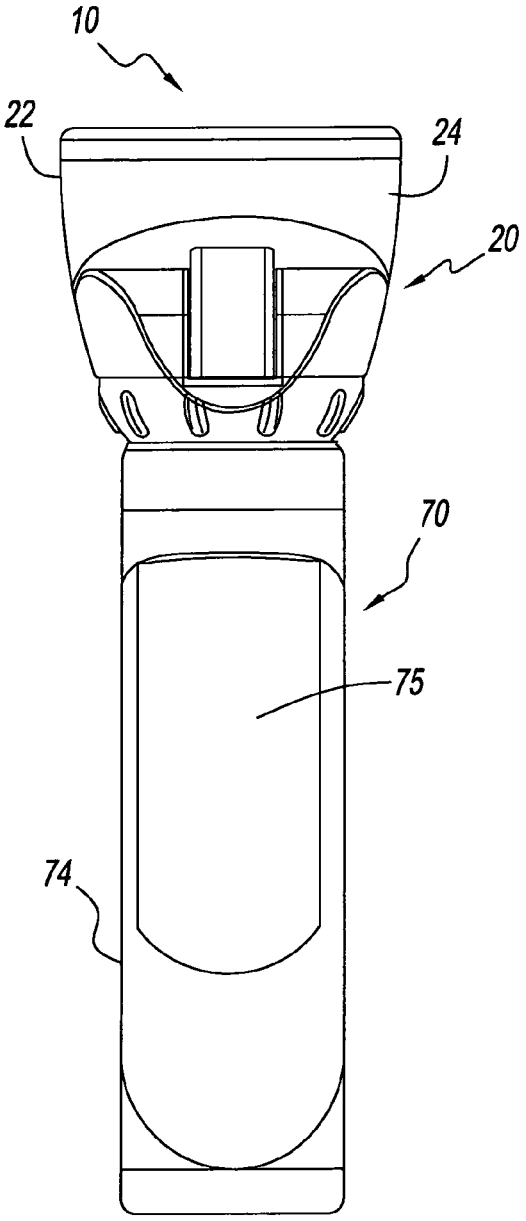
FIG. 2 is a bottom view of the flashlight of FIG. 1.
Figure 3:
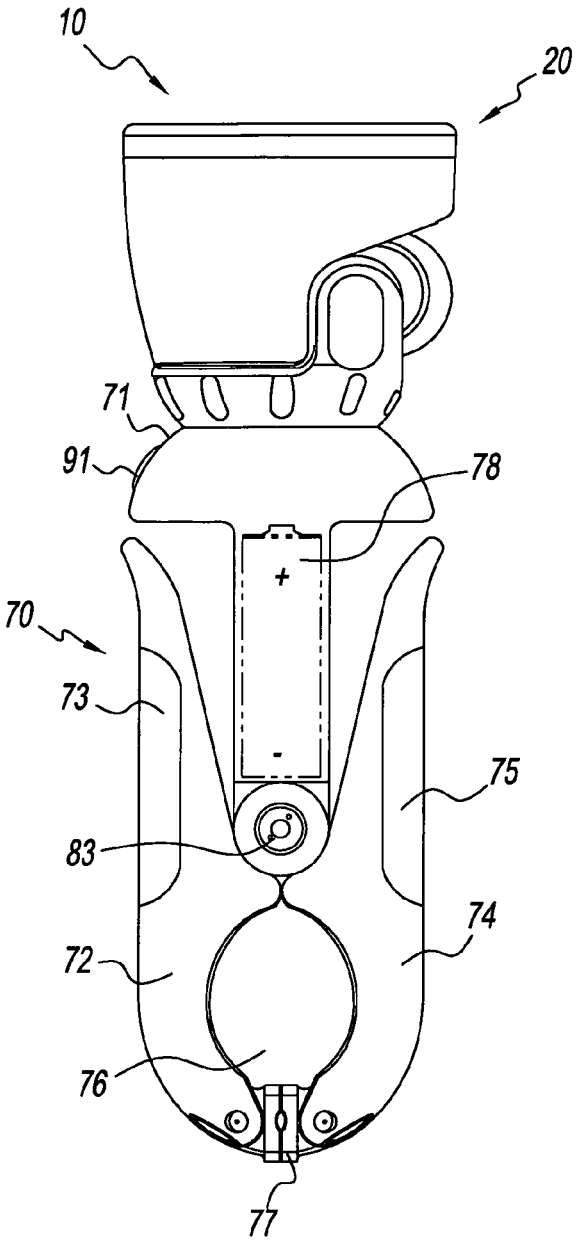
FIG. 3 is a right-side view of the flashlight of FIG. 1.
Figure 4:
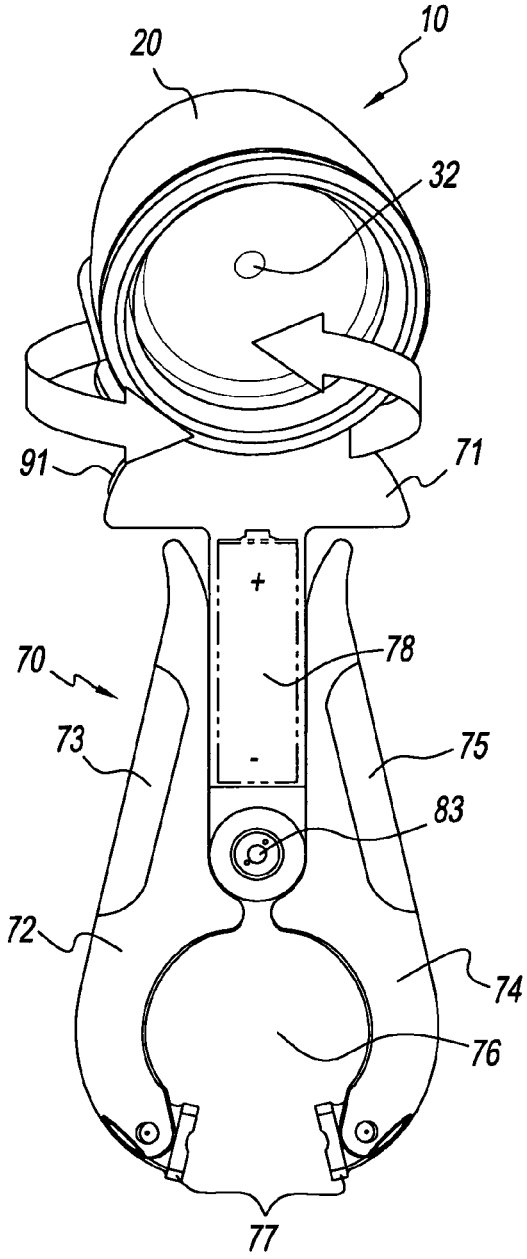
FIG. 4 is a right-side view of the flashlight of FIG. 1, showing the clamp in a closed position.
Figure 5:
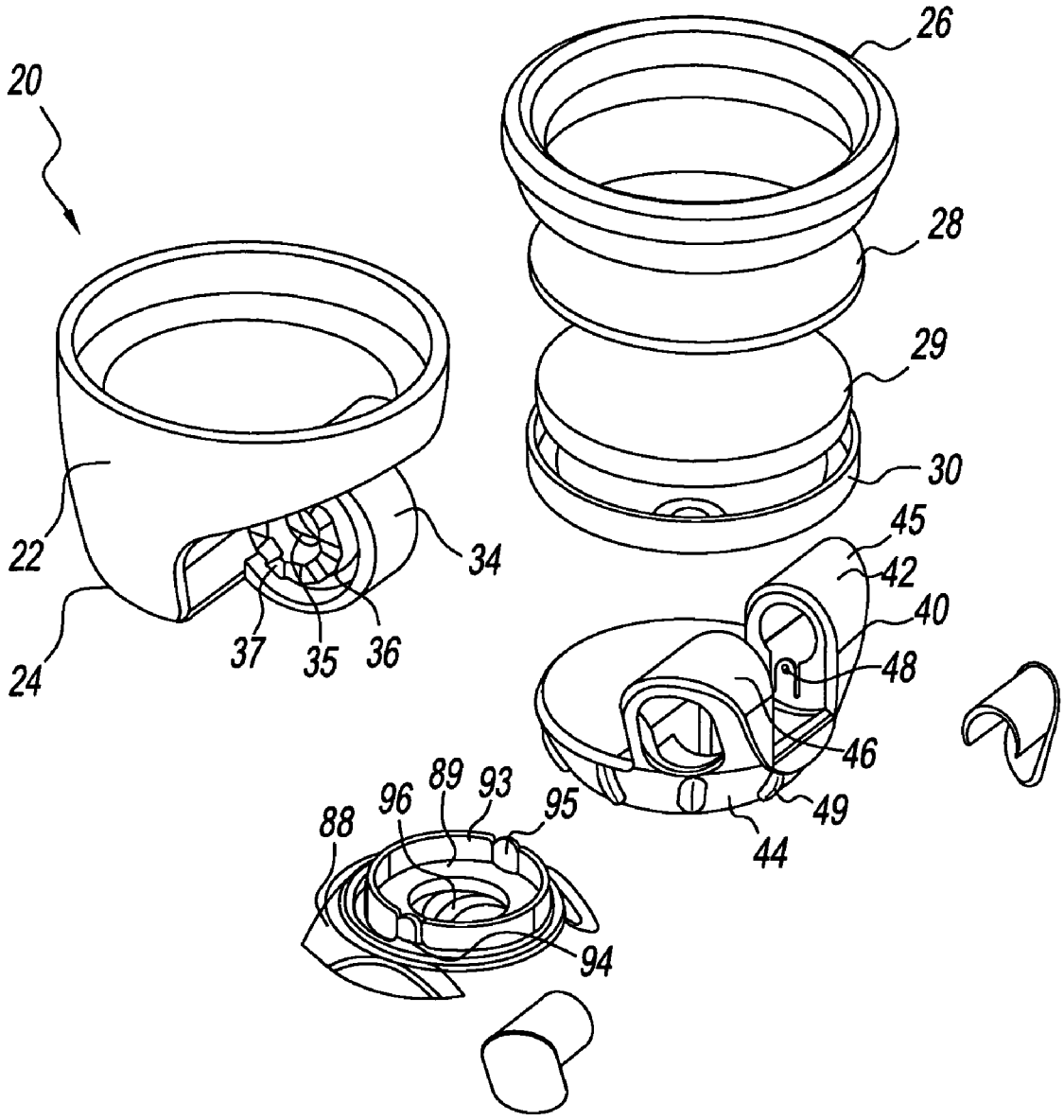
FIG. 5 is an exploded view of the flashlight of FIG. 1.

Referring to FIGS. 1-5, a first embodiment of the flashlight of the present disclosure, referenced by numeral 10, is shown. Flashlight 10 has a head 20 and a handle 70. Handle 70 further comprises support member or base 71, first clamp arm 72, and second clamp arm 74, the latter two of which are mounted or connected to each other in such a way as to be biased in a closed position, as shown in FIG. 3. First clamp arm 72 and second clamp arm 74 can be gripped and squeezed together by a user, such that a clamp 76, defined by an end of first clamp arm 72 and an end of second clamp arm 74, opens and can be attached to a fixed object. When clamp 76 is in its closed position, first clamp arm 72 and second clamp arm 74 can be easily gripped by a user, rendering flashlight 10 portable.

The present disclosure therefore provides a flashlight 10, that a user can use in hands-free operation by attaching it to a fixed object, which still remains portable for the user when removed from the fixed object. Clamp 76 is integrated into the handle 70, so that handle 70 can double as a grip for the user for portable use, and can also be used to affix flashlight 10 to a stationary object. This is a significant improvement over the flashlights of the prior art, which use cumbersome methods to affix the flashlight to a stationary object, and which are not portable. Flashlight 10 of the present disclosure can have a similar profile to a traditional flashlight when clamp 76 is closed, as first clamp arm 72 and second clamp arm 74 can form a substantially cylindrical body for handle 70.

The present disclosure also provides a unique battery housing 78, which in one embodiment can be disposed along a central axis of handle 70, as shown in FIG. 3. This also represents a significant advantage over the flashlights of the prior art, which often require bulky tubes or cylinders for holding batteries.

For ease of describing flashlight 10, the words "front," "back," "top," and "bottom" will be used from the point of view of a user pointing head 20 at an object, with first clamp arm 72 on top of second clamp arm 74. These directional terms are used only for describing flashlight 10, and are not meant to limit the interpretation of the features discussed below.

As previously discussed, first clamp arm 72 and second clamp arm 74 are biased together, so that clamp 76 is in a closed position. A spring, actuator, or other biasing device (not shown) can be placed between first clamp arm 72 and second clamp arm 74, to create tension between first clamp arm 72, second clamp arm 74, and battery housing 78, and effect the bias. First clamp arm 72, second clamp arm 74, and the biasing device can be connected to each other with a pivot pin 83 that travels through corresponding holes in first clamp arm 72, second clamp arm 74, and the biasing device. Pivot pin 83 can be disposed on a bottom end of battery housing 78, as shown in FIG. 3. The biasing device can be connected to first clamp arm 72, and/or second clamp arm 74, and can pass through an opening in the battery housing 78.

The present disclosure contemplates any biasing devices that can create tension between first clamp arm 72, second clamp arm 74, and housing 78, such as tension springs, extension springs, compression springs, integral plastic springs, wire or coil springs, and flat springs. These devices can be positioned around battery housing 78, and come into contact with inner surfaces of first clamp arm 72 and second clamp arm 74. Alternatively, there can be two separate biasing devices, one disposed between battery housing and first clamp arm 72, and another disposed between battery housing 78 and second clamp arm 74.

Thus, a user can grasp handle 70, and squeeze first clamp arm 72 and second clamp arm 74 toward one another, which opens clamp 76. Clamp 76 can then be affixed to an object, to allow for hands-free operation of flashlight 10. Alternatively, the user can grasp or hold handle 70, and use flashlight 10 in a portable manner. This dual capability of handle 70 provides a convenience not found in the prior art. Currently available flashlights having clamps that can be affixed to objects are not designed for portable use. Currently available flashlights that are portable, however, do not have the ability to be affixed to an object.

The top surface of first clamp arm 72 can have an overmold 73 attached thereto, to provide for easier gripping of handle 70. Second clamp arm 74 can also have an overmold 75 disposed on a bottom surface, and the ends of first clamp arm 72 and second clamp arm 74 that form clamp 76 can each be covered with an overmold 77, to prevent clamp 76 from marking the surface to which it is affixed. All of the overmolds 73, 75, and 77 can be made with a material such as thermoplastic rubbers or other elastomers.

Base 71 of handle 70 can also have battery housing 78 connected thereto. As seen in FIG. 3, the cylindrical profile of handle 70 is not adversely affected by the placement of battery housing 78. This space-saving feature of flashlight 10 allows for space between first clamp arm 72 and second clamp arm 74, which facilitates in the ability of flashlight 10 to be affixed to an object, in the manner described above. This is a significant improvement over currently available flashlights, which often require bulky battery compartments that occupy a significant portion of the space within the handle.

In the shown embodiment, battery housing 78 houses one (1) triple-A (AAA) battery. However, the present disclosure contemplates a number of different batteries, or a plurality of batteries, which can be used in flashlight 10. Smaller batteries can be placed in any number of locations within flashlight 10, and are not limited to battery housing 78. For example, batteries can also be disposed in a compartment disposed within either base 71, first clamp arm 72, second clamp arm 74, or within head 20.

Button membrane 91 and button bezel 92 are connected to base 71 of handle 70, for example with a friction or snap fit connection. Button membrane 91 can selectively place the batteries disposed within battery housing 78 in electrical communication with a light source 32 (shown in FIG. 4) disposed within head 20, in the manner discussed below. Thus, a user can turn light source 32 on and off by pressing button membrane 91.

Head 20 has body 22 and tapered end 24. Body 22 has a substantially cylindrical profile, and tapered end 24 narrows in the direction of handle 70. Body 22 also has bezel 26 connected thereto. When assembled, head 20 has lens 28, cover 29, lens housing 30, and light source 32 disposed therein. These components are concerned with the optics of flashlight 10, and ensure that a proper beam is directed out of head 20. Cover 29 can be made of an acrylic. Bezel 26 fits over lens 28, cover 29, lens housing 30, and light source 32, and contains these components within head 20. Light source 32 can be a light-emitting diode (LED).

Body 22 has a pivot wheel 34 connected thereto. Pivot wheel 34 can be a separate component that is connected or fastened to body 22, or can be integrally formed as one component with body 22. Head 20 further has mount 40, to which pivot wheel 34 is operably connected. Mount 40 can have a pivot portion 42, and a rotary portion 44. Rotary portion 44 can have a first arm 45 and a second arm 46, each of which are hollow. A pivot pin (not shown) can pass through the hollow portions of first arm 45 and second arm 46, and also through a hole 35 within pivot wheel 34. In this manner, head 20 can rotate about the longitudinal axis of the pivot pin, in a direction away from, and back toward, rotary portion 44 of mount 40.

In one embodiment, pivot wheel 34 can rotate about pivot portion 42 in the manner described above, and the user can place head 20 in any position along the arc of rotation. A friction fit between pivot wheel 34, first arm 45, and second arm 46 ensures that head 20 stays in the desired position. In another embodiment, pivot wheel 34 can have a raised inner diameter 36, on one or both sides of pivot wheel 34, and a plurality of bumps 37 disposed thereon. First arm 45 and/or second arm 46 can have an awl 48 disposed therein. When pivot wheel 34 is operably connected to pivot portion 42 of mount 40 in the manner described above, awl 48 can engage grooves located between bumps 37 of inner diameter 36. In this manner, there can be one or more "stops" along the arc of rotation of head 20.

Rotary portion 44 of mount 40 can be separately formed from, and connected to, pivot portion 42. Alternatively, the two can be integrally formed as one component. Rotary portion 44 can be rotatably connected to base 71 of handle 70, and can rotate about a longitudinal axis of handle 70. Raised edge 93, disposed on flat portion 89 of base 71, can engage a groove (not shown) on an underside of rotary portion 44. In one embodiment, flat portion 89 has a pair of stops 94 disposed thereon, that can limit the rotation of rotary portion 44.

Rotary portion 44 of mount 40 can also have an inner diameter (not shown) disposed on an underside thereof, with a plurality of grooves disposed thereon. Flat portion 89 can also have second awls 95 disposed thereon, which can engage the grooves in the inner diameter of rotary portion 44. In this manner, rotary portion 44 can have a number of discrete stops along the arc of rotation. In another embodiment, rotary portion 44 can be placed in any position along the arc of rotation by a user. Rotary portion 44 can also have a plurality of grips 49 disposed thereon, which can assist with the user with the adjustment of mount 40.

The inner diameter of rotary portion 44 can also have a pair of lead holes (not shown) disposed therein. Light source 32 can be in electrical communication with the batteries disposed within battery housing 78 via electrical leads that are passed through these lead holes, through a center hole 96 disposed on flat portion 89 of base 71, to button membrane 91, and the batteries.

Figure 6:
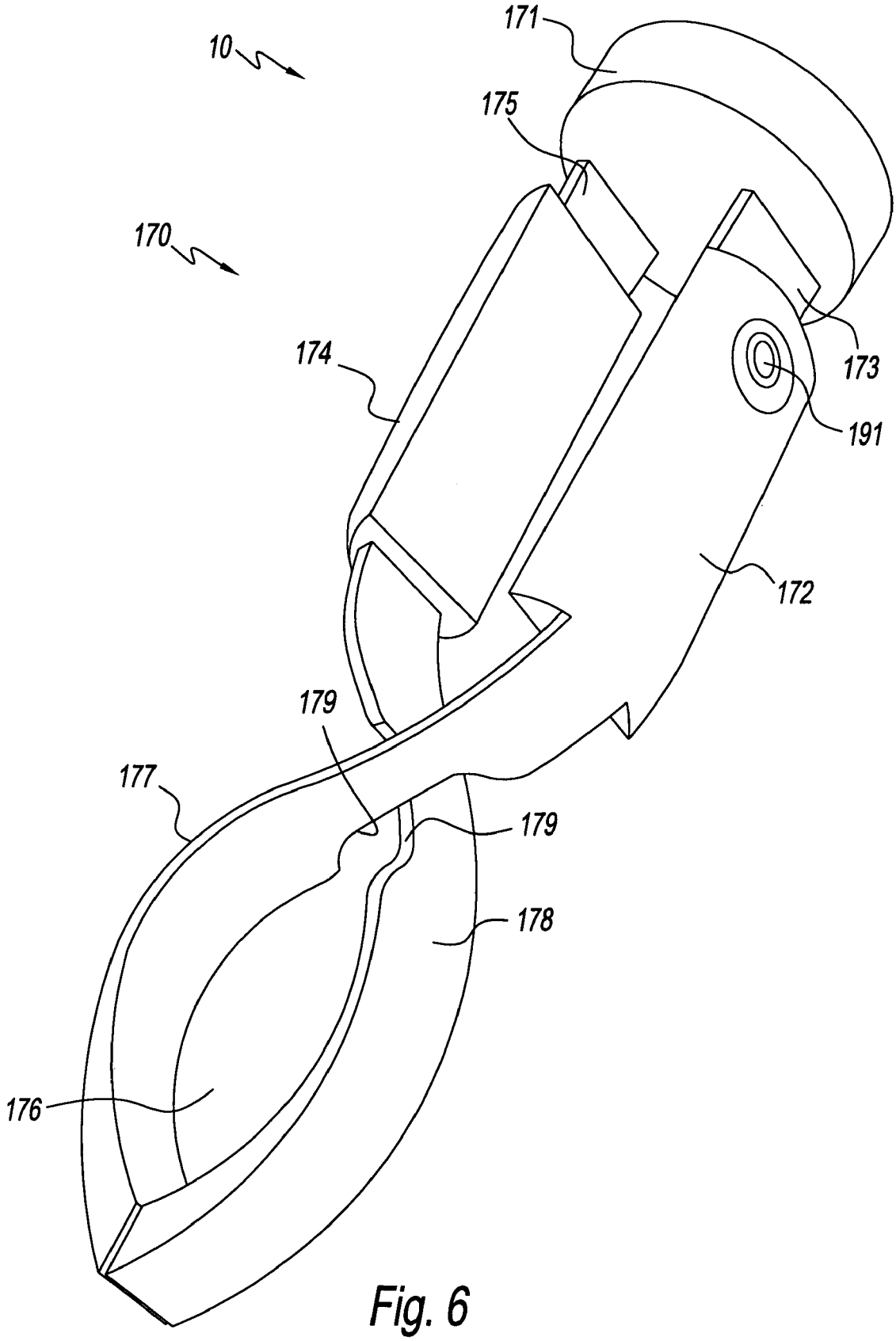
FIG. 6 is a top, perspective view of a second embodiment of the flashlight of the present disclosure.
Figure 7:
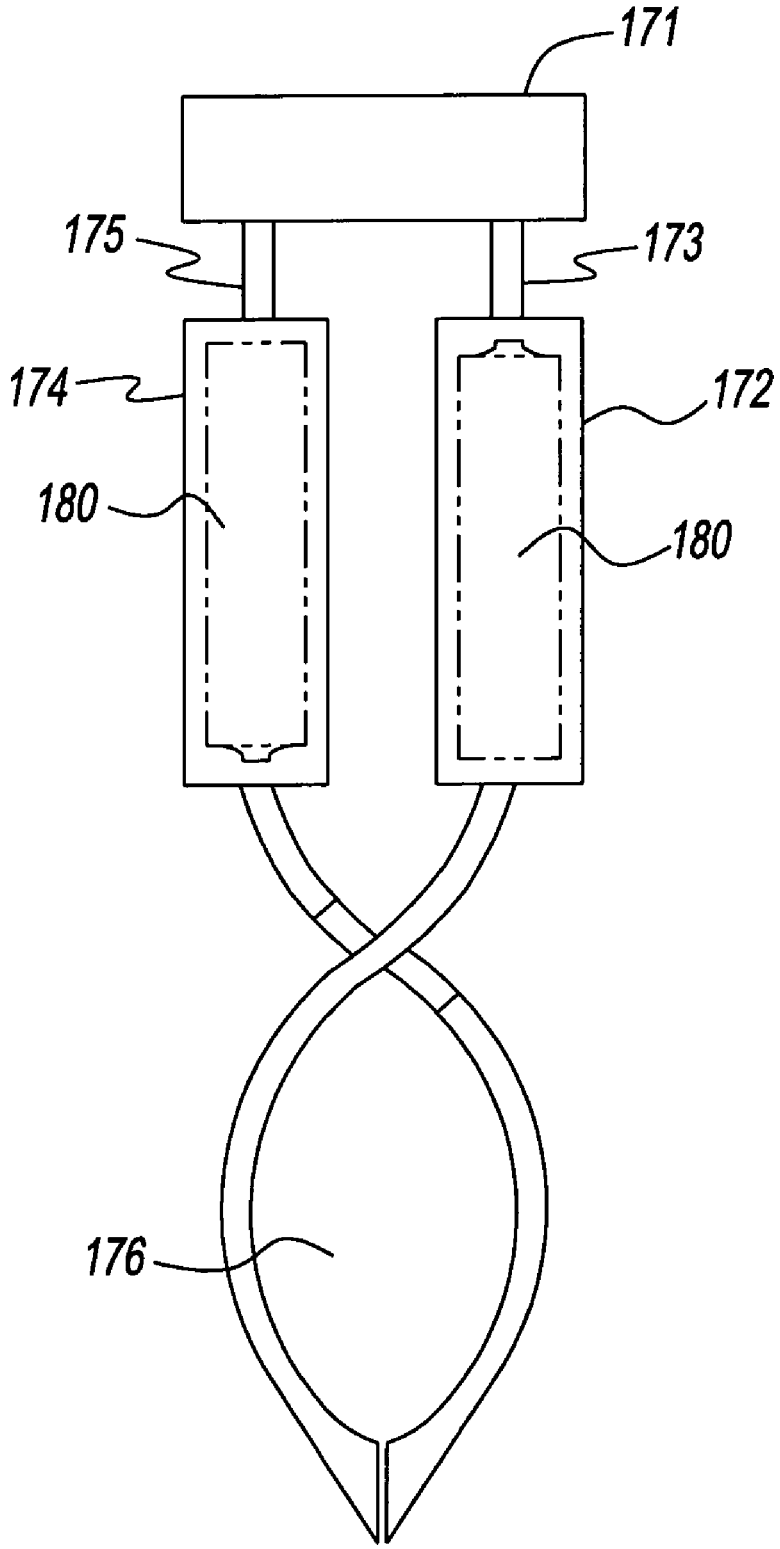
FIG. 7 is a left-side view of the flashlight of FIG. 6.

Referring to FIGS. 6 and 7, an alternative embodiment of the handle for flashlight 10 is shown and referred to by numeral 170. Handle 170 has first clamp arm 172, and second clamp arm 172. First clamp arm 172 and second clamp arm 174 can have upper portions 173 and 175, which are connected to support member or base 171. Upper portions 173 and 175 are connected to base 171, but also have flex, so that first clamp arm 172 and 174 can be moved with respect to each other. Head 20 can be connected to base 171 in the same manner as with base 71, as discussed above.

First clamp arm 172 and second clamp arm 174 also have lower portions 177 and 178. Lower portions 177 and 178 intertwine with each other as shown, and form clamp 176.

First clamp arm 172 and second clamp arm 174 are biased together so that clamp 176 is in a closed position. To open clamp 176 and affix flashlight 10 to an object, the user squeezes first clamp arm 172 and second clamp arm 174 together. One or more notches 179 cut into lower portions 177 and 178 can facilitate movement between first clamp arm 172 and second clamp arm 174. The materials that make up these components, and how they are formed, create the tension between first clamp arm 172 and second clamp arm 174. With handle 170, therefore, there is no need for a spring or other device to create this tension.

Thus, handle 170 can provide additional advantages over the lights of the prior art. As with handle 70, clamp 176 is integrated intro handle 170, which avoids cumbersome attachments and additional components that would need to be attached to flashlight 10 in order to provide clamping capability. The simple design of handle 170 can provide the user with a hands-free mode of operation, without the use of a spring or other device. Handle 170 also provides the user with the ability to carry flashlight 10 portably.

Referring specifically to FIG. 7, handle 170 can have one or more battery compartments 180. Battery compartments 180 can be disposed in either first clamp arm 172 or second clamp arm 174, or both. This design and location of battery compartment(s) 180 provides additional advantages for handle 170. The location of the batteries within one or both of the clamp arms allows for an open space between first clamp arm 172 and second clamp arm 174, which provides a lighter design for flashlight 10, and for a wide range of motion between the clamp arms.

Batteries disposed within compartments 180 are in electrical communication with light source 32 of head 20. In one embodiment, electric leads can run from battery compartments 180, through upper portions 173 and 175, which can be hollowed out for this purpose, through base 171, and into head 20. The batteries are selectively placed in and out of communication with light source 32 through the use of button membrane 191, which can be disposed on either first clamp arm 172, second clamp arm 174, base 171, or head 20.

Again, the present disclosure contemplates a number of different batteries, or a single battery, which can be used in flashlight 10. Smaller batteries can be placed in any number of locations within flashlight 10, and are not limited to battery compartments 180. For example, batteries can also be disposed in a compartment disposed within either base 171, first clamp arm 172, second clamp arm 174, or within head 20.

Any of the above described components can be made of materials such as acrylonitrile butadiene styrene (ABS), nylon, or other plastics, or can be made of cast or stamped metal.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated for carrying out this disclosure, but that the disclosure will include all embodiments falling within the scope of the claims.

What is claimed is:

1. An illumination device, comprising:

a head comprising a light-emitting portion;

a support member connected to said head, wherein said support member runs along a longitudinal axis of the illumination device, in a direction away from said head;

a first clamp arm and a second clamp arm connected to said support member at first ends of said first clamp arm and said second clamp arm, so that a gripping portion is formed at second ends of said first clamp arm and said second clamp arm, wherein each of said second ends is on an opposite end of said first clamp arm and said second clamp arm from said first ends; and a battery compartment within each of said first clamp arm and said second clamp arm, wherein said support member comprises a pivot pin through a bottom portion thereof, and wherein said first clamp arm, said second clamp arm, and said support member are connected to each other with said pivot pin.

2. The illumination device of claim 1, wherein said first clamp arm and said second clamp arm have plastic overmolds connected to outer surfaces thereof.

3. The illumination device of claim 1, wherein said first clamp arm and said second clamp arm are biasingly connected, so that said clamp is inclined toward a closed position.

4. The illumination device of claim 1, wherein said support member can store a least one battery.

5. The illumination device of claim 1, wherein said first clamp arm and said second clamp arm are biasingly connected to said support member, so that said clamp is inclined toward a closed position.

6. The illumination device of claim 1, wherein said head comprises a body that comprises said light-emitting portion, and a mount that is connected to said support member.

7. The illumination device of claim 6, wherein said mount comprises a pivot portion and a rotary portion.

8. The illumination device of claim 7, wherein said pivot portion is pivotally connected to said body, and said rotary portion is rotatably connected to said support member.

9. The illumination device of claim 6, wherein said body is cylindrically shaped, with a diameter that tapers, so that said diameter is smaller at an end of said body that connected to said mount than it is at an end that is adjacent to said light-emitting portion.

10. An illumination device, comprising:

a head comprising a light-emitting portion;

a support member connected to said head;

a first clamp arm and a second clamp arm connected to said support member at first ends of said first clamp arm and said second clamp arm, so that a gripping portion is formed at second ends of said first clamp arm and said second clamp arm, wherein each of said second ends is on an opposite end of said first clamp arm and said second clamp arm from said first ends, wherein said first clamp arm and said second clamp arm have flexible ends that are connected to said support member, which flex when said first clamp arm and said second clamp arm are moved toward one another, and wherein said first clamp arm and said second clamp arm have clamp ends opposite said flexible ends, which intertwine to form said clamp.

11. The illumination device of claim 10, wherein said first clamp arm and said second clamp arm are biasingly connected to said support member, so that said clamp is inclined toward a closed position.

12. The illumination device of claim 11, wherein at least one of said first clamp arm and said second clamp arm has a battery compartment disposed therein.

13. An illumination device, comprising:

a head comprising a light-emitting portion;

a mount connected to said head, wherein said head is rotatably connected to said mount;

a base connected to said mount, wherein said mount is rotatably connected to said base;

a first clamp arm and a second clamp arm connected to said base at first ends of said first clamp arm and said second clamp arm, so that a gripping portion is formed at second ends of said first clamp arm and said second clamp arm, wherein each of said second ends is on an opposite end of said first clamp arm and said second clamp arm from said first ends; and a battery compartment within each of said first clamp arm and said second clamp arm.

14. The illumination device of claim 13, wherein said head is cylindrically shaped, with a diameter that tapers, so that said diameter is smaller at an end of said body that connected to said mount than it is at an end that is adjacent to said light-emitting portion.

15. The illumination device of claim 13, further comprising at least one battery compartment within said head.

* * * * *